United States Patent [19]

Andrews

[11] Patent Number: 4,579,472

[45] Date of Patent: Apr. 1, 1986

[54] DEVICES FOR HOLDING SHEETS

[75] Inventor: Robert C. Andrews, Worcester, United Kingdom

[73] Assignee: Geevax Limited, Tewkesbury, England

[21] Appl. No.: 642,344

[22] Filed: Aug. 20, 1984

[30] Foreign Application Priority Data

Aug. 20, 1983 [GB] United Kingdom ..... 8322672

[51] Int. Cl.[4] ..... B42F 3/00; B42F 13/02; B42F 13/36

[52] U.S. Cl. ..... 402/63; 402/62; 402/61

[58] Field of Search ..... 24/255, 457, 516; 281/45; 402/61, 62, 63, 64, 65, 68; 16/DIG. 13, 16/225, 321, 324, 325, 349

[56] References Cited

U.S. PATENT DOCUMENTS

| | | | |
|---|---|---|---|
| 1,129,242 | 2/1915 | Smith | 402/62 |
| 2,666,240 | 1/1954 | Maccaferri | 24/457 |
| 2,690,861 | 10/1954 | Tupper | 16/DIG. 13 |
| 2,888,055 | 4/1959 | Dingman | 402/63 |
| 3,574,472 | 3/1971 | Cott | 402/61 |
| 4,079,765 | 3/1978 | Hatayan | 24/516 |
| 4,304,499 | 12/1981 | Purcocks | 402/61 |
| 4,305,675 | 12/1981 | Jacinto | 402/62 |
| 4,489,466 | 12/1984 | Bakker | 24/516 |

FOREIGN PATENT DOCUMENTS

| | | |
|---|---|---|
| 437936 | 11/1935 | United Kingdom . |
| 956010 | 4/1964 | United Kingdom . |
| 1093754 | 12/1967 | United Kingdom . |
| 1196243 | 6/1970 | United Kingdom . |

*Primary Examiner*—Paul A. Bell
*Assistant Examiner*—Paul M. Heyrana
*Attorney, Agent, or Firm*—Young & Thompson

[57] ABSTRACT

This invention relates to a device or clip 10 for holding sheets of paper comprising a main body 11 and a flexible element 12. The element 12 consists of a strip of flexible material having pointed arms 13, which can be threaded through holes in the paper prior to passing through apertures 14 in the body 11, so the paper can be held between the element 12 and the base 15 of the body 11. A lid 16 is hinged along one edge of the base 15 and when closed it covers the bent over arms 13 preventing their withdrawal through the aperture 14, while also protecting the user from the sharp ends 20 of the arms 13.

4 Claims, 3 Drawing Figures

DEVICES FOR HOLDING SHEETS

This invention relates to devices for holding sheets of material and in particular, but not exclusively, to devices for holding paper.

Many devices have been designed for holding sheets of paper together. Almost all have disadvantages, for example they are made of expensive materials such as metal, they are not easily colour coded, they have a tendency to cut or spike the user, nor they will not hold single sheets of paper satisfactorily.

It is an object of the present invention to provide an improved device for holding sheet material.

From one aspect the invention consists in a device for holding sheet material comprising a body interengagable with an element, the element having a pair of flexible arms onto which sheet material can be threaded and the body being threadable on the arms by means of respective apertures and having means for holding the free ends of the arms on the body to trap the sheet material between the element and the body and means for enclosing the free ends.

In a preferred embodiment the element is formed as a plastics strip with the arms projecting upwardly from the main portion and having tapered ends. The body may have a channel for receiving the free ends, when they are folded into the body and the means for holding may be a hinged lid, which can be snap-fittingly engaged into a closed position in which it overlies and encloses the free ends.

Preferably the body is made of plastics material such as Polypropylene and formed by injection moulding.

From another aspect, the invention consists in a device formed as an integral element for holding sheet material comprising a pair of converging arms, for gripping the sheet material, interconnected by a flexible web and a pair of spaced levers extending from the web on the opposite side to the arms, whereby movement of the levers towards one another causes opening movement of the arms.

The device is preferably extruded in a plastic, such as nylon, so that it can be formed in any length and may be used as a clip or as a sheet binding element. The tips of the arms may be interengaged by forming a recess or channel on one and a co-operating projection on the other. This construction enables a very thin sheet to be gripped whilst allowing the gap required by the extrusion die.

In any of the above cases the devices may be formed in any chosen colour and of any suitable length and may be provided with surfaces or recesses for receiving, labelling or advertising material.

The invention may be performed in various ways and specific embodiments will now be described, by way of example, with reference to the accompanying drawings, in which.

Figure 1:
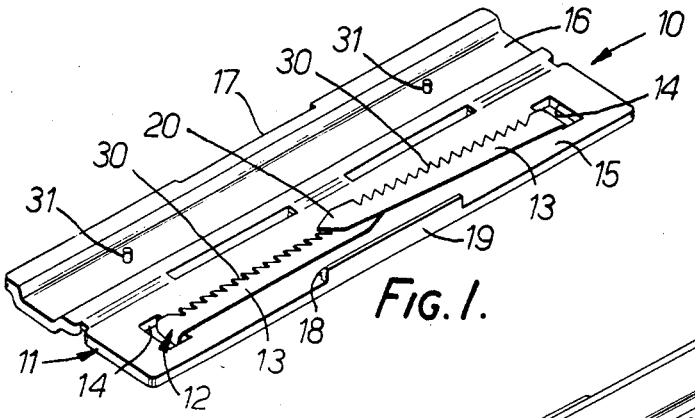
FIG. 1 is a perspective view from above of a filing clip in its assembled but open position.

Referring to the drawing a clip 10 for holding sheets of paper comprises a main body 11 and a flexible element 12. The element 12 comprises a strip of flexible material having arms 13, which can be threaded through holes in paper prior to passing through apertures 14 in the body 11 so that the paper can be held between the elements 12 and the base 15 of the body 11.

Figure 2:
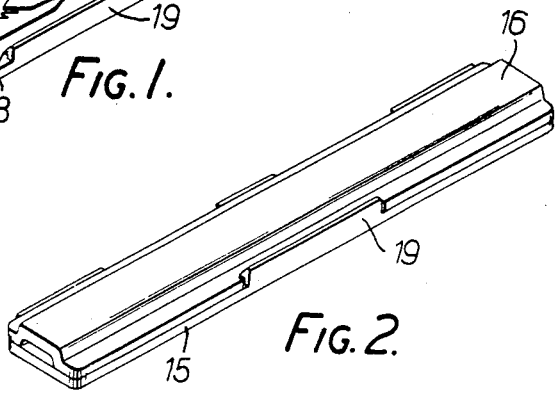
FIG. 2 shows the clip of FIG. 1 in its closed position.

A lid 16 is hinged along one edge of the base 15 and can be swung from its open position (shown in FIG. 1) into the closed position shown in FIG. 2, where its rebated edge 17 snaps over a projection 18 on an upstanding wall 19 formed on the opposite side of the base 15. In this position the lid 16 completely covers the bent over arms 13 preventing their withdrawal through the apertures 14 and also projecting the user from the sharp ends 20 of the arms 13.

However, if a large thickness of papers is threaded on the arms 13, the lid 16 is sometimes unable to prevent the arms 13 slipping through the aperture 14. To avoid this problem the edges of the arms 13 may be serrated as shown at 30 to provide a ratchet formation, which can lockingly engage respective pegs 31, formed on the lid 16, when the lid 16 is closed.

A single central projection 18 may be replaced by a pair of projections (not shown) positioned adjacent each end of the main body 11 for snapping over suitably rebated edges.

In contrast in known clips of this general type the arms and the retaining devices are normally made of metal and are extremely sharp. These frequently cut the user.

The clip 10 can be made in any suitable manner, for example by injection moulding of Polypropylene and may be formed in many different ways, for example the central wall 19 may be replaced by two spaced walls (not shown) positioned adjacent either end of the base 15.

Figure 3:
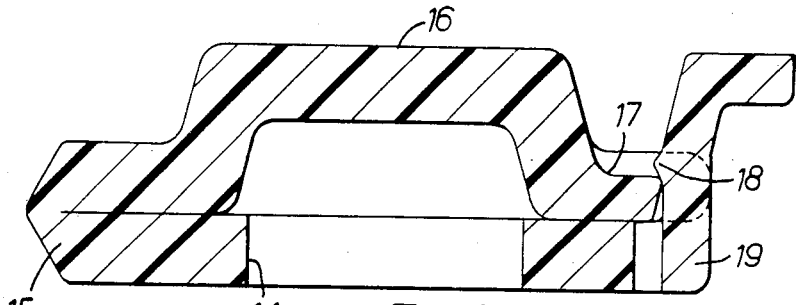
FIG. 3 is a section through the clip of FIG. 1 with the element omitted.
Figure 4:
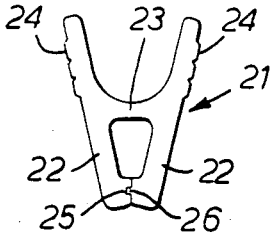
Figure 5:
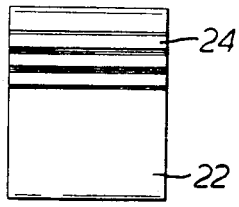

An alternative clip is shown in FIG. 3 to 4. This clip 21 comprises a pair of converging arms 22 interconnected by a flexible web 23 and having lower extensions 24 on the opposite side of the web 23. One of the arms 22 has a channel 25 along its gripping edge and receives a projection 26 formed on the other arm. This arrangement enables the clip to be extruded, for example from nylon, whilst ensuring that the clip can grip even the thinnest sheet of paper. The clip can be opened by squeezing the lever extensions towards one another.

As the clip can be extruded it can be made in any suitable length and it may be used for binding sheet material.

I claim:

1. A device for holding sheet material comprising an elongate element having a pair of flexible arms on to which sheet material can be threaded and an integral plastics moulded body having: a base defining a pair of apertures through which respective arms on the body can be threaded to trap the sheet material between the member and the base, lid means, hinge means, integral with the base, for hinging the lid for movement between an open position in which the element may be detached from the base and a closed position in which the lid means holds the free ends of the arms against the base and encloses them within the body and catch means upstanding on the base, opposite the hinge means for releasably snap-fittingly engaging the lid means to retain the lid means in it's closed position.

2. A device as claimed in claim 1 wherein the element is formed as a plastics strip with the arms projecting upwards from a main portion and having tapered ends.

3. A device as claimed in claim 1 wherein the lid means define a clip for receiving the free ends of the element when two are folded over the base.

4. A device as claimed in claim 1 wherein the body and the element have co-operating formations which are engagable to prevent longitudinal movement of the ends when they are held by the body.

* * * * *